United States Patent [19]

Habich et al.

[11] 4,307,968

[45] Dec. 29, 1981

[54] FONT CHANGING APPARATUS FOR DAISY WHEEL PRINTER

[75] Inventors: Adolph B. Habich; Ronald E. Hunt, both of Austin, Tex.

[73] Assignee: International Business Machines Corp., Armonk, N.Y.

[21] Appl. No.: 98,287

[22] Filed: Nov. 28, 1979

[51] Int. Cl.[3] ..... B41J 1/30

[52] U.S. Cl. ..... 400/171; 400/144.2

[58] Field of Search ..... 400/171, 144.2, 144.3, 400/149, 150, 151, 151.1

[56] References Cited

U.S. PATENT DOCUMENTS

| | | | |
|---|---|---|---|
| 3,645,372 | 2/1972 | Noell et al. | 400/171 |
| 3,892,303 | 7/1975 | Willcox | 400/171 |
| 4,026,403 | 5/1977 | Inose et al. | 400/144.2 X |
| 4,197,022 | 4/1980 | Dollenmayer | 400/144.2 |
| 4,202,639 | 5/1980 | Rello | 400/171 |
| 4,209,262 | 6/1980 | Savage | 400/144.2 |

OTHER PUBLICATIONS

Hunt et al., IBM Tech. Discl. Bulletin, vol. 13, No. 5, 10/70, p. 1149.

Bleau, IBM Tech. Discl. Bulletin, vol. 18, No. 10, 3/76, pp. 3350–3351.

*Primary Examiner*—Edward M. Coven

*Attorney, Agent, or Firm*—James H. Barksdale, Jr.

[57] ABSTRACT

An under-the-cover automatic font changing apparatus for a daisy wheel printer which utilizes a print element housed in a cartridge during printing. The apparatus is adapted to exchange print elements in the cartridge. Included in the apparatus are an elongated and vertically oriented rack, a plurality of print element holding means located along the rack, drive means for vertically elevating and lowering the rack in a single plane, and means for causing a selection motor drive hub included in the printer to be translated toward and away from the print element for a print element change. During printing, the drive hub is for rotating the print element housed in the cartridge. Cooperating with the apparatus is a carrier positionable along and above the rack and carrying the cartridge. The cartridge has spring means included therein for cooperating with the drive hub upon insertion of one of the holding means into the cartridge. The spring means and drive hub cooperate for (1) installing a print element included in the cartridge on the holding means for removal of the print element from the cartridge, and (2) removing a print element from the holding means for loading the cartridge with a print element.

12 Claims, 4 Drawing Figures

FONT CHANGING APPARATUS FOR DAISY WHEEL PRINTER

DESCRIPTION

Cross-References To Related Applications

U.S. patent application Ser. No. 053,649, filed 06/29/79, entitled "Carrier for Print Element And Ribbon Cartridges", and having A. B. Habich and R. E. Hunt as inventors.

U.S. patent application Ser. No. 053,646, filed 06/29/79, entitled "Daisy Wheel Printer Carrier" and having A. B. Habich and R. E. Hunt as inventors.

U.S. patent application Ser. No. 053,648, filed 06/29/79, entitled "Method And Apparatus For Connecting And Disconnecting A Motor And A Print Element", and having A. B. Habich and R. E. Hunt as inventors.

U.S. patent application Ser. No. 098,288, filed 11/28/79, entitled Automatic Typefont Loader, and having W. L. Dollenmayer as inventor.

U.S. patent application Ser. No. 968,320, filed Dec. 11, 1978, entitled "Print Package", and having A. B. Habich and R. E. Hunt as inventors now abandoned.

U.S. patent application Ser. No. 968,321, filed Dec. 11, 1978, entitled "Print Element Cartridge", and having A. B. Habich and R. E. Hunt as inventors.

U.S. patent application Ser. No. 968,322, filed Dec. 11, 1978, now U.S. Pat. No. 4,245,916 entitled "Daisy Wheel Print Element Structured For Use In A Cartridge", and having A. B. Habich and R. E. Hunt as inventors.

U.S. patent application Ser. No. 215,603, filed Dec. 12, 1980, entitled "Print Package", and having A. B. Habich et al. as inventors.

BACKGROUND OF THE INVENTION

1. Field of the Invention

This invention generally relates to automatic font changing apparatus. More specifically, this invention deals with apparatus to be included under the cover of a daisy wheel printer which utilizes a print element housed in a cartridge during printing. The apparatus is adapted to effect an automatic exchange of print elements in the cartridge.

2. Description of the Prior Art (Prior Art Statement)

Representative of the closest known prior art are the above cross-referenced application Ser. No. 098,288, of Dollenmayer, and U.S. Pat. No. 4,026,403 to Inose et al.

In the Dollenmayer application is disclosed an under-the-cover font changer for a daisy wheel printer. The font changer includes a swing-away print element carrying rack. The rack is positionable such that carried extra print elements are stored in a horizontal position under a platen during a printing operation. For a print element change, the rack is swung upward and toward a selection motor drive shaft. The upward swing of the rack is to bring the print elements into a vertical position. Also disclosed is the translation of selection motor toward and away from the rack for a print element change. The functional similarities between the two applications are the use of a rack to position a print element for a print element change, and translation of a selection motor to effect a print element change. Structurally though, there are many differences. The most important as related to the instant application are that (1) extra print elements are mounted on a rack which is vertically oriented and positionable for loading and unloading a print element into, and out of a print element cartridge, (2) a spring means is included in the cartridge for cooperating with a translatable selection motor for facilitating unloading and loading of a print element, and (3) a latch mechanism is connected to the rack and operable by the cartridge upon elevating and lowering the rack for maintaining print elements on the rack when absent from the cartridge.

In U.S. Pat. No. 4,026,403 there is disclosed an under-the-cover carousel type font changer for a daisy wheel printer. Other than the fact that the font changer can be mounted under the cover, the structure disclosed is totally different than that of the instant application.

U.S. Pat. Nos. 3,892,303 and 3,645,372, and IBM Technical Disclosure Bulletin Vol. 13, No. 5, October 1970, page 1149, are representative of other known art related to automatic font changers. Since these patents and the IBM TDB are considered to represent no better art than that described above, no further explanation is deemed necessary.

SUMMARY OF THE INVENTION

An under-the-cover font changer is provided for a daisy wheel printer. The printer has a platen, a carrier for both a print element cartridge and a translatable selection motor, and a leadscrew for controlling escapement of the carrier along the platen. On the end of the carrier adjacent the platen is a receptacle for receiving the print element cartridge. The print element cartridge is for housing a print element. Located within the print element cartridge is a bowed and vertically oriented leaf spring. Located below the receptacle is a vertically oriented and horizontally elongated rack extending along the platen.

On the rack is a plurality of upwardly projecting yokes for carrying print elements. For loading a selected print element carried by one of the yokes into the print element cartridge, the leadscrew is first rotated for aligning the receptacle and print element cartridge with the selected print element. Following alignment, the rack is elevated. When the print element is positioned in the print element cartridge, the selection motor is translated toward the print element. Upon such translation, a drive hub connected to the motor urges the print element against the spring and disengages the print element from the yoke. Thereafter, the rack and empty yoke are lowered. For removing or unloading a print element from the print element cartridge, the receptacle and an empty yoke are first aligned. Then the rack is elevated until the yoke is positioned in engaging relationship with the print element. The selection motor is thereafter translated away from the print element. This results in withdrawal of the drive hub and permits the spring to cause engagement of the print element and the yoke. Thereafter, the rack is lowered with the print element mounted on the yoke.

DESCRIPTION OF THE PREFERRED EMBODIMENT

General Description

Figure 1:
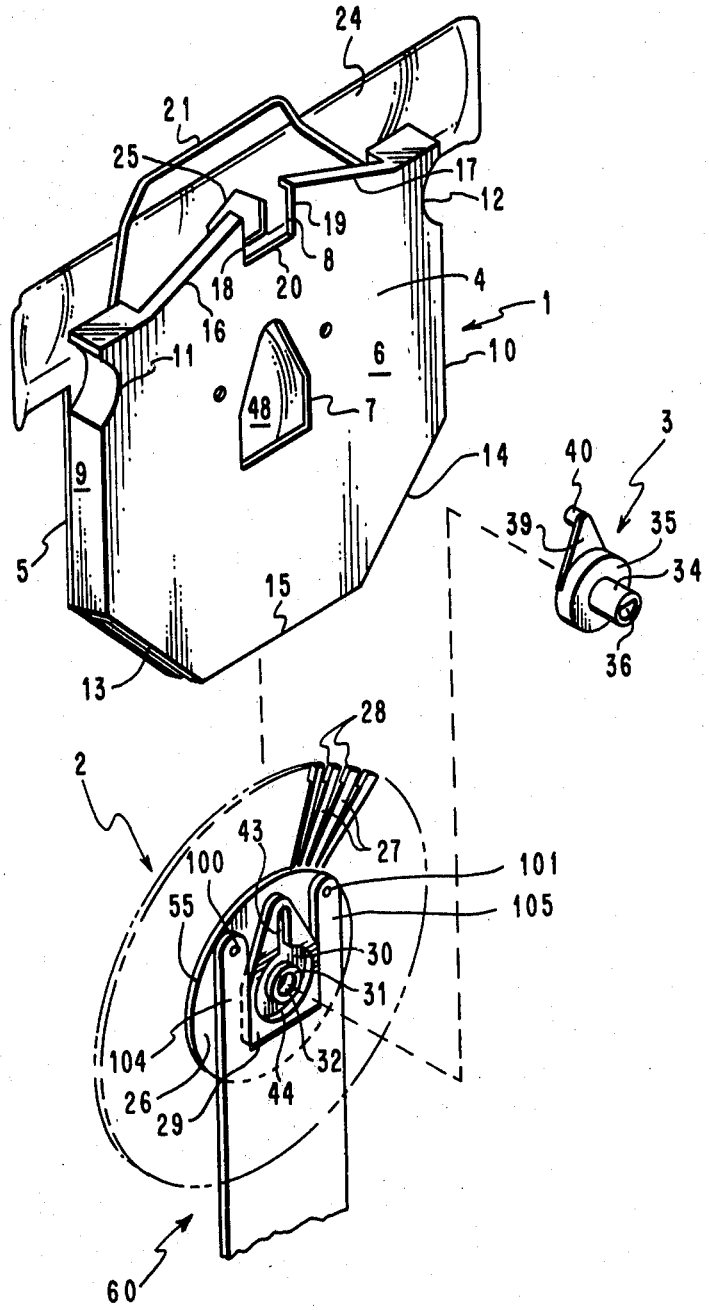
FIG. 1 is an exploded front perspective view illustrating the relationship between a print element cartridge, print element, print element yoke, and selection motor drive hub.
Figures 3, 4:
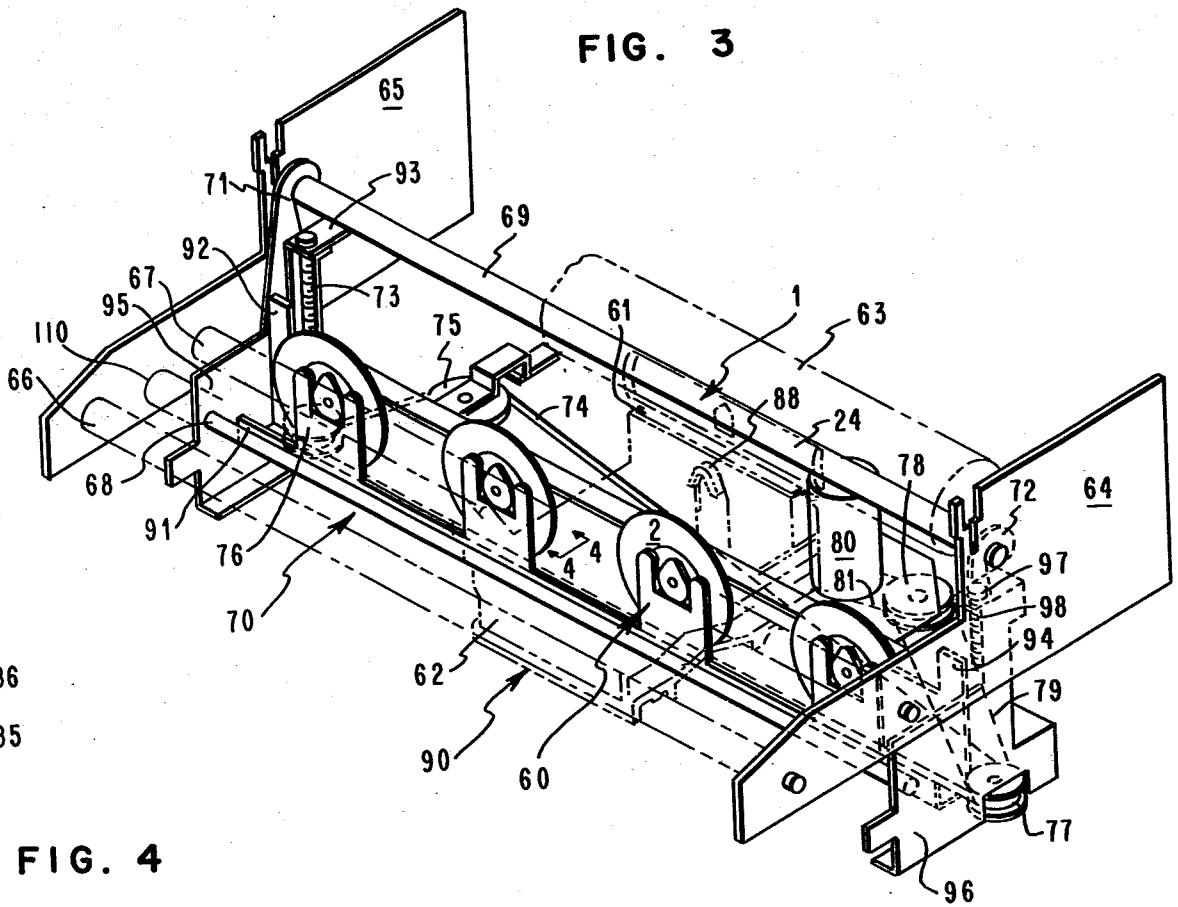
FIG. 3 is a front perspective view of the under-the-cover font changing apparatus according to this invention.
FIG. 4 is a side view taken along lines 4—4 in FIG. 3 and illustrating a latch mechanism for maintaining a print element on a yoke when absent from the cartridge.

For a general understanding of the components included in and affected by the apparatus of this invention, reference is first made to FIGS. 1 and 3.

In these figures are shown a print element cartridge generally designated by reference numeral 1, a daisy wheel printer print element generally designated by reference numeral 2, a selection motor drive hub generally designated by reference numeral 3, and a font holding yoke generally designated by reference numeral 60. In the course of actual printing operations during which print element 2 is rotated by hub 3, cartridge 1 has print element 2 housed therein. Also, at this time cartridge 1 is housed in a receptacle 61 in a motor and cartridge carrier 62. For a change in cartridges and included print elements, cartridge 1 and receptacle 61 are structured to permit removal of cartridge 1 from receptacle 61. For a change in print elements within cartridge 1, print element 2 and cartridge 1 are structured to permit print element 2 to be inserted into, and removed from, cartridge 1. Insertion and removal of print element 2 into and from cartridge 1 can be by an automatic font changing apparatus generally designated by reference numeral 70. Details of each of the above-mentioned components are set out below.

PRINT ELEMENT CARTRIDGE

With the above in mind, reference is made primarily to FIG. 1 and specifically to cartridge 1. Cartridge 1 is essentially made up of a shell 4 and a back cover 5. Shell 4 has a front 6 having an orientation opening 7 and a print hammer slot 8. Front 6 faces a print mechanism including a selection motor and a print hammer carried by carrier 62 (FIG. 3). Slot 8 is for accommodating the print hammer which is used in a well known manner to facilitate printing. Orientation opening 7 is somewhat arrowhead in shape and generally centralized within front 6. Opening 7 is for cooperating with print element 2 to maintain print element 2 properly oriented during non-printing use as will be described later herein. Integral with front 6 are sides 9 and 10. Sides 9 and 10 have recesses 11 and 12, respectively, which accommodate an operator's thumb and finger for grasping cartridge 1 and manually removing it from receptacle 61. The lower portion of front 6 has converging tapered edges 13 and 14 which terminate with bottom edge 15. Shell 4 has no side walls along either tapered edges 13 and 14 or bottom edge 15. The outer periphery of back 5 is symmetrical with the periphery of front 6 from recesses 11 and 12 of sides 9 and 10 to bottom 15. Thus, when shell 4 is connected to back 5, cartridge 1 is provided with an open bottom which serves as a loading and unloading opening for the insertion and removal of print element 2 by font changing apparatus 70.

Tapered edges 13 and 14 and the matching portion of back 5 serve two useful purposes. One is that the corners thus eliminated result in a reduction in the mass of cartridge 1, and thus carrier 62, during printing operations. The other is that guides are provided for manual insertion of cartridge 1 into receptacle 61 in carrier 62.

The upper portion of shell 4 has ramps 16 and 17 which extend from adjacent recesses 11 and 12 to near the top center of shell 4 and terminate in slot 8. Slot 8 has sides 18 and 19 and a bottom 20. Slot 8 is large enough to permit clear passage of a print hammer during printing, yet small enough to reduce the chances of an operator having thumb or finger access to print element 2. That is, operator access to print element 2 is restricted by the size of slot 8. Ramps 16 and 17 are to provide enclosure of the upper portion of print element 2 when housed in cartridge 1, and permit as much operator writing line viewing as possible.

Figure 2:
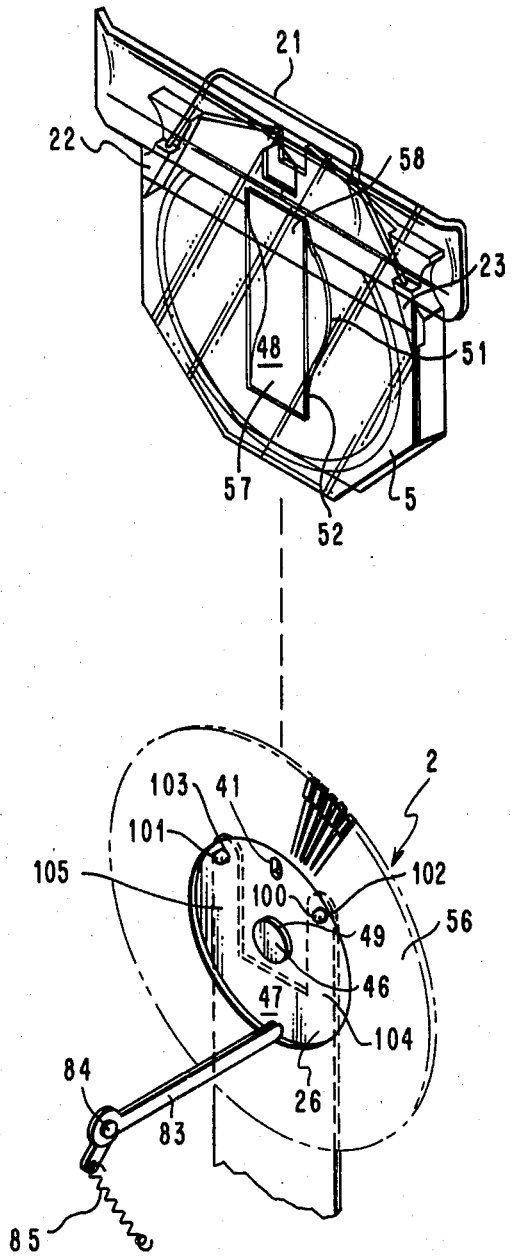
FIG. 2 is a rear perspective view of the components illustrated in FIG. 1 with the exception of the drive hub.

Shell 4 carries ribbon guide 21 which can be made up of a metallic wire rod shaped as shown. Referring for a moment to FIG. 2, the interior of shell 4 has integral internal abutments 22 and 23 having openings therein for accepting the ends of ribbon guide 21. Ribbon guide 21 is for guiding a typewriter ribbon in lifted and lowered positions relative to slot 8 during printing.

A cardholder 24 is carried on the upper end of back 5 as an integral portion thereof. Horizontally centered within cardholder 24 is a type opening 25 which is generally aligned with slot 8. The requirements for the dimensions of opening 25 and slot 8 are somewhat different. That is, opening 25 must be (1) located such that it can be properly aligned with a printer platen 63 (FIG. 3), and (2) of sufficient width when on-the-fly printing is considered to permit rebound of a print element petal in time to avoid contact with a side of opening 25. While accommodating these requirements, opening 25 is also to be small enough to restrict operator access to print element 2. Also, front 6 and back 5 are spaced sufficiently close together to restrict operator access through either the top or bottom of cartridge 1. Therefore, when print element 2 is housed in cartridge 1, the only area of print element 2 readily contactable by an operator during normal handling of cartridge 1 is that accessible through opening 7.

Print Element

Reference will now be made to print element 2 shown in FIG. 1. As pointed out above, element 2 is to be housed and rotated within cartridge 1 during printing operations. Element 2 is located intermediate the insides of front 6 and back 5 during rotation thereof. Print element 2 is generally daisy wheel in shape and has a circular shaped central hub 26. Connected to hub 26 are radially extending petals 27. Adjacent the outer extremities of petals 27 are types or character slugs 28 which are utilized in a printing process in a well known manner. Types 28 on petals 27 are located on the printing side of element 2 illustrated in FIG. 2. The side of element 2 illustrated in FIG. 1 is the impact side. On the impact side, petals 27 are structured to be impacted by a print hammer.

Referring to FIG. 2, central hub 26 is generally dish shaped. Due to the dish shape, a flanged periphery 55 is provided and it is to this periphery 55 that petals 27 are connected.

Hub 26 carries an orientation protrusion 29 on its protruding side as shown in FIG. 1. Protrusion 29 engulfs the axis of rotation of element 2, and has a peripheral arrowhead shape corresponding to opening 7 in cartridge 1. Stated alternatively, opening 7 is a matching opening for protrusion 29. The arrowhead shapes of protrusion 29 and opening 7 are symmetrical with respect to a radius extending vertically and perpendicularly from the axis of rotation of print element 2. Taken as a whole though, these shapes are both asymmetrical and insure one desired orientation of element 2 within cartridge 1.

Within protrusion 29 is a skillet shaped depression 30 also engulfing the axis of rotation of element 2 and having the protruding side of hub 26 as a bottom. Within depression 30 is a cylindrical extension 31 having an opening 32. Opening 32 is axially aligned with the axis of rotation of element 2, and has a bottom below the bottom of depression 30. Opening 32 is for accepting a selection motor drive shaft which extends through hub 3 for centering and preventing wobble of element 2. This will be described in greater detail below.

Selection Motor Drive Hub

Reference is now made to drive hub 3 illustrated in FIG. 1. Drive hub 3 is made up of a cylinder 34 connected to a cupped flange 35. Axially centered within cylinder 34 and flange 35 is D-shaped opening 36 extending therethrough. Opening 36 is for accepting a matching selection motor drive shaft (not shown) having a D-shaped cross-section. D-shaped opening 36 insures a positive rotational connection between the drive shaft and hub 3. Hub 3 is connected along the drive shaft, and may be bonded thereto. If the fit between the drive shaft and opening 32 is sufficiently close, opening 32 is relatively deep, and the drive shaft extends relatively far into opening 32, element 2 is stabilized in a radial direction perpendicular to the axis of rotation of element 2 and the drive shaft. That is, any tendency for element 2 to wobble is significantly reduced. Since front 6 and back 5 are to be closely spaced, any wobble of print element 2 on the drive shaft would be particularly undesirable from wear, breakage and free rotation standpoints.

Drive Hub And Print Element

Refer next to both FIGS. 1 and 2. Carried on the periphery of flange 35 is radially extending arm 39. Adjacent the outer end of arm 39 is drive pin 40 structured to communicate with opening 41 in element 2. Opening 41 is located in the end of handle 43 of skillet shaped depression 30 and extends through element 2. Pin 40, when inserted into opening 41, is utilized to cause element 2 to rotate upon rotation of the drive shaft.

Pin 40 and opening 41 have similar peripheries. That is, both have flat sides and arcuate ends. The width of opening 41 is only slightly larger than the width of pin 40. This is to reduce play between element 2 and hub 3 during rotation of element 2 by hub 3. To accommodate varying tolerances though, the length of opening 41 is somewhat greater than the length of pin 40. Therefore, with the overall size of opening 41 being greater than pin 40, the flat sides provide sufficient driving contact areas to reduce wear and indentation problems.

The outer periphery of flange 35 is greater in diameter than the inner periphery 44 of depression 30. As such, the face of flange 35 abuts the face of protrusion 29 for radially aligning and stabilizing element 2 to further aid in reducing print element wobble. A flush fit between the face of flange 35 and the stabilizing face of protrusion 29 is aided by a spring 48 which urges element 2 toward hub 3. The part played by spring 48 will be more fully discussed later in the specification. An important point to note at this time is that hub 3 is not to be displaced from the end of the drive shaft sufficiently for the end of the drive shaft to completely bottom in opening 32 of element 2. Otherwise, a complete mating of the face of flange 35 and the face of protrusion 29 may be prevented. Also, even though the outer periphery of flange 35 is greater than the inner periphery 44, flange 35 is still small enough for hub 3 to be freely passed through opening 7 when properly oriented.

The reason for the pan portion of skillet shaped depression 30 is to reduce the mass of element 2. In like manner, flange 35 is cup shaped to reduce mass. Any reduction in mass results in improved response time in starting and stopping rotation of element 2.

Cartridge And Print Element

Refer next to FIG. 2. In this figure is shown the back or printing side 56 of print element 2. Carried on back 56 is a protruding bearing stud 46 centered within the dished side 47 of central hub 26. Stud 46 extends beyond the dish and is adapted to communicate with spring 48 located in cartridge 1. Stud 46 is made up of a cylinder 49 and can have a bullet shaped extension (not shown) having an arcuate cross-section. Stud 46 acts as a bearing for element 2 against spring 48 during rotation of element 2. Spring 48 in turn acts as a bearing surface for stud 46. When element 2 is housed in cartridge 1 and not being utilized in a printing process, spring 48 provides a thrust against stud 46 to bias and maintain element 2 latched in cartridge 1.

Before further discussing the relationship of element 2 and spring 48, several specific details of spring 48 and cartridge 1 will be brought out. As best illustrated in FIG. 2, spring 48 is a leaf spring having a bowed center portion 51 extending toward and located adjacent opening 7. In fact, front 6 and back 5 are spaced, and spring 48 is bowed, such that portion 51 acts against the inside of front 6. Back 5 has an inside rectangular depression 52 for accepting and aiding in retaining spring 48 in a desired position relative to opening 7. That is, spring 48 is to be held in place and remain properly oriented both when bowed as shown and when somewhat extended during the time element 2 is located within cartridge 1 and between spring 48 and front 6. Ends 57 and 58 are located in depression 52 and act against the inside of back 5. Depression 52 is sufficiently long to accommodate spring 48 when extended. Spring 48 is sufficiently long to provide a gradual ramp from ends 57 and 58 to bow 51. Ends 57 and 58 are maintained in depression 52 by front 6 acting against bow 51. Thus, the orientation and length of spring 48, and the extent of bow 51 are such that spring 48 serves as a ramp for stud 46 of element 2 for camming portrusion 29 toward opening 7 during insertion of element 2 into cartridge 1.

When element 2 is inserted into cartridge 1 from the bottom of cartridge 1, the force of spring 48 must be overcome. As alluded to above, this is because of the proximity of the insides of back 5 and front 6 and the bowed portion 51 acting against the inside of front 6 adjacent opening 7. During insertion of element 2 into cartridge 1, stud 46 will ride up spring 48 from end 57 toward bow 51. With end 57 seated in depression 52, there will be no snagging of stud 46 on end 57. When protrusion 29 and opening 7 are aligned, spring 48 will urge and cam protrusion 29 into opening 7 for engagement therewith. Upon engagement of protrusion 29 and opening 7, element 2 is latched in a properly oriented or desired rotational position within cartridge 1.

Referring again to the relationship of spring 48 and element 2, the width of spring 48 is of great importance when a print element is to be inserted into an empty cartridge. The horizontal width of spring 48 must be sufficient to eliminate the possibility of a print element petal 27 extending through opening 7 during insertion of element 2 into cartridge 1. If spring 48 is made relatively narrow compared to opening 7, a few petals will be forced out of the plane of the remaining petals. To eliminate this possibility, spring 48 in the illustrated embodiment is made wider than opening 7. This results in all petals adjacent opening 7 remaining in the same plane. The vertical orientation of spring 48 is also important relative to petals 27. That is, since petals 27 are radially extending, there will be no snagging on spring 48 if vertically oriented.

When print element 2 is to be used for printing, cartridge 1 having element 2 latched therein is inserted into receptacle 61. Thereafter, drive hub 3 and attached selection motor and drive shaft are translated toward central hub 26. The drive shaft will mate with opening 32, pin 40 will mate with opening 41, and the face of flange 35 will contact the face of protrusion 29. Further translation of hub 3 in the same direction will result in stud 46 of element 2 causing ends 57 and 58 of spring 48 to extend in the vertical direction. Ultimately, protrusion 29 will clear opening 7 and element 2 will be unlatched for rotation within cartridge 1. During rotation of element 2 for selection and printing, arm 39 and pin 40 will be located within cartridge 1 and spring 48 will act as a bearing surface for stud 46.

Referring again to print element 2 in FIGS. 1 and 2, the dish shaped central hub 26 has a number of advantages. One is that due to the structural arrangement disclosed, print element 2 taken as a whole can be made relatively thin and still resist warp. In fact, the thickness of central hub 26, excluding protrusion 29 and stud 46, can be essentially the same as the overall thickness of element 2. Another is that protrusion 29 is brought closer to orientation opening 7. This reduces the chances of interference between the remainder of print element 2 and cartridge 1. Further, due to the relationship of the bow in leaf spring 48 to stud 46, the remainder of print element 2 is spaced from the greater part of spring 48 during rotation of element 2.

For manual removal of print element 2 from cartridge 1, the operator procedure is to contact protrusion 29 with a thumb and then press in and down. This action results in an unlatching of print element 2 and a downward displacement thereof. If the lower outer periphery of element 2 is relatively close to bottom 15 when element 2 is latched in cartridge 1, very little downward displacement of element 2 is required to supply a sufficient area of element 2 for an operator to grasp.

Font Changing Apparatus

Reference is next made to FIG. 3 for the following structural and operational description of font changing apparatus 70. Apparatus 70 is utilized for automatically effecting an exchange of print elements in cartridge 1.

In FIG. 3 is shown a printer frame made up of sides 64 and 65 secured together by escapement rails 66 and 67 and a top support rail 69. Mounted on escapement rails 66 and 67 is a carrier generally designated by reference numeral 90. Carrier 90 is for carrying both a selection motor and carrier 62. Carrier 62 is for in turn carrying print element cartridge 1. Carrier 90 and thus carrier 62 are translated along platen 63 by a leadscrew 110.

Top support rail 69 in addition to supporting printer frame sides 64 and 65 is used for supporting hangers 71 and 72. Hangers 71 and 72 carry font changing apparatus 70.

Integral with hangers 71 and 72 are plates 95 and 96. Plates 95 and 96 carry support means (not shown) for a drive motor 80, pulleys 75, 76, 77 and 78, and worm gear brackets 93 and 97. Carried in turn by worm gear brackets 93 and 97 are worm gears 73 and 98. Followers (not shown) connect worm gears 73 and 98 and L-shaped uprights 92 and 94, respectively. Integral with uprights 92 and 94 is an elongated and horizontally disposed rack 91. Rack 91 is vertically oriented, and vertically elevatable and lowerable upon rotation of worm gears 73 and 98. Worm gears 73 and 98 are rotatable by motor 80 through pulleys 75, 76, 77, and 78 and belts 81, 79, and 74. Belt 81 is looped over the shaft (not shown) of motor 80, and around pulley 78. Belt 79 is looped around pulleys 78 and 77. Belt 74 is looped around pulleys 77, 75, and 76. Worm gears 73 and 98 form shafts for pulleys 76 and 77, respectively.

Reference is next made to FIGS. 1 and 2 in conjunction with FIG. 3. Integral with rack 91 are four vertically extending font holding yokes such as yoke 60. Yoke 60 is made up of a pair of spaced apart fingers 104 and 105. Fingers 104 and 105 have horizontally extending pins 100 and 101, respectively, secured thereto. Pins 100 and 101 extend toward platen 63 and are for communicating with openings 102 and 103 in print element 2.

Refer next to FIGS. 2, 3, and 4. Integral with the lower portion of rack 91 and centrally located behind each yoke, such as yoke 60, along the length of rack 91, are L-shaped members, such as 82, for carrying a latch mechanism. The latch mechanism is for holding and maintaining print elements on the yokes when absent from the cartridge. The latch mechanism is made up of a latch arm 83 which is pivotably connected to member 82 by shaft 84. Arm 83 has a latch end 99 for maintaining a print element on yoke 60 as will be described later herein. Connected to the opposite end 86 of arm 83 is one end of a tension spring 85. The other end of tension spring 85 is connected at point 87 on member 82. A stop (not shown) can be provided to prevent end 99 from extending above the horizontal position shown.

Carried by carrier 90 is a horizontally disposed selection motor having a shaft (not shown) extending perpendicularly toward a platen 63. The selection motor is translatable toward and away from platen 63. Connected to the selection motor shaft is hub 3. Located on the motor side of receptacle 61 is a dormer 88 for maintaining hub 3 in a home position when the selection motor is translated away from platen 63 and hub 3 is brought out of engagement with print element 2.

It is to first be assumed that cartridge 1 is empty (contains no print element), rack 91 is in its lowermost position, carrier 90 has been translated along platen 63 by a leadscrew 110 to a position where yoke 60 and print element 2 are aligned with and under cartridge 1, hub 3 has been translated away from platen 63 and is positioned in dormer 88, and print element 2 is to be loaded into cartridge 1 for a printing operation. At this time pins 100 and 101 will be in engagement with openings 102 and 103 in print element 2. This engagement is maintained by end 99 acting against element 2 and below stud 46.

Hub 3 is translated away from print element cartridge 1 upon rotation of a cam 68. A crank (not shown) is operable by cam 68. A crank similar to arm 83 can be used in conjunction with cam 68 to translate hub 3 away from cartridge 1. That is, by reorienting arm 83 clockwise 90°, end 86 can ride on the far side of cam 68 and end 99 can act against the end of the selection motor carrying hub 3.

Motor 80 is then turned on for elevating rack 91 for inserting print element 2 into cartridge 1. During the upward travel of rack 91 and after print element 2 has been partially inserted into cartridge 1, end 99 of arm 83 will be contacted by the bottom of back 5 and rotated in a downward direction. This results in an unlatching of print element 2 from yoke 60 to the extent that print element 2 is not positively held or maintained on yoke 60. As described earlier, print element 2 will be wedged between the back of front 6 and spring 48. Upon rack 91 arriving at its uppermost position, protrusion 29 and opening 7 will be in alignment. At this time, hub 3 is translated toward print element 2. Translation of hub 3 in this case is for urging print element 2 against spring 48 and causing a disengagement of pins 100 and 101, and openings 102 and 103. Upon disengagement, rack 91 is lowered to its lowermost position. The loading operation has now been completed and cartridge 1 is loaded with print element 2 ready for printing operations.

Translation of hub 3 toward print element 2 is upon additional rotation of cam 68. This permits the selection motor, which is spring biased toward cartridge 1, to restore and cause engagement of hub 3 and element 2.

For unloading print element 2 from cartridge 1, operations similar to those described above are followed. Carrier 90 is positioned upon rotation of leadscrew 110 along platen 63 for aligning yoke 60 and cartridge 1. Hub 3 is not withdrawn or translated away from cartridge 1 and print element 2 at this time, though. Rack 91 is first elevated to its uppermost position for aligning pins 100 and 101, and openings 102 and 103. Following pin and opening alignment, hub 3 is translated away from print element 2. During this translation, spring 48 will cause engagement of pins 100 and 101, and openings 102 and 103. Upon pin and opening engagement, rack 91 is lowered to its lowermost position with yoke 60 carrying print element 2. During the lowering of rack 91, end 99 of arm 83 will ride along back 5 of cartridge 1 until the bottom of the cartridge is reached. At this time, arm 83 will rotate toward a horizontal position and end 99 will maintain and latch element 2 on yoke 60.

While the operations set out above have been with reference to yoke 60 and element 2, it will be appreciated by those skilled in the art that the remaining yokes and print elements shown in FIG. 3 could be similarly utilized.

It is deemed necessary to discuss two points in further detail. One is related to the spacing of fingers 104 and 105. The other is the relative location of pins 100 and 101, and openings 102 and 103. Fingers 104 and 105 are spaced such that protrusion 29 will fit therebetween. This will aid in maintaining element 2 properly oriented on a yoke. Pins 100 and 101, and openings 102 and 103 are to be located sufficiently high to insure engagement thereof when end 99 is not acting against element 2.

In summary, an under-the-cover font changer is provided for a daisy wheel printer. The printer has a platen, a carrier for both a print element cartridge and a translatable selection motor, and a leadscrew for controlling escapement of the carrier along the platen. On the end of the carrier adjacent the platen is a receptacle for receiving the print element cartridge. The print element cartridge is for housing a print element. Located within the print element cartridge is a bowed and vertically oriented leaf spring. Located below the receptacle is a vertically oriented and horizontally elongated rack extending along the platen.

On the rack is a plurality of upwardly projecting yokes for carrying print elements. For loading a selected print element carried by one of the yokes into the print element cartridge, the leadscrew is first rotated for aligning the receptacle and print element cartridge with the selected print element. Following alignment, the rack is elevated. When the print element is positioned in the print element cartridge, the selection motor is translated toward the print element. Upon such translation, a drive hub connected to the motor urges the print element against the spring and disengages the print element from the yoke. Thereafter, the rack and empty yoke are lowered. For removing or unloading a print element from the print element cartridge, the receptacle and an empty yoke are first aligned. Then the rack is elevated until the yoke is positioned in engaging relationship with the print element. The selection motor is thereafter translated away from the print element. This results in withdrawal of the drive hub and permits the spring to cause engagement of the print element and the yoke. Thereafter, the rack is lowered with the print element mounted on the yoke.

While the invention has been particularly shown and described with reference to a particular embodiment, it will be understood by those skilled in the art that various changes in form and detail may be made without departing from the spirit and scope of the invention.

What is claimed is:

1. Automatic font changing apparatus for a daisy wheel printer which utilizes a print element housed in a cartridge during printing, and which includes a horizontally mounted platen and a cartridge carrier horizontally translatable along said platen, said cartridge carrier including a receptacle for housing said cartridge, said apparatus comprising in combination:

(a) a vertically oriented and elevatable elongated rack normally disposed beneath said receptacle;

(b) holding means on said rack for holding a print element; and (c) means for vertically elevating said rack in a single plane for causing insertion of said holding means into said cartridge when said cartridge is aligned with said holding means for (1) loading a held print element into said cartridge when said cartridge is empty, and (2) positioning said holding means in engaging relationship with a print element for unloading a print element from said cartridge when said cartridge is loaded and when said holding means is not holding a print element.

2. Apparatus according to claim 1 wherein said print element has an orientation protrusion on a central hub thereof and an opening in said central hub spaced from said orientation protrusion.

3. Apparatus according to claim 2 wherein said holding means includes a finger having a pin thereon for communicating with said opening in said central hub.

4. Apparatus according to claim 3 wherein said holding means includes a yoke having a plurality of said fingers spaced to accept said orientation protrusion therebetween.

5. Apparatus according to claim 4 including spring means in said cartridge for urging said print element toward said pin.

6. Apparatus according to claim 5 including a drive hub for rotating said print element and which is translatable (1) toward said print element for disengaging said print element from said holding means during loading of said cartridge, and (2) away from said print element to permit said spring means to cause engagement of said print element and said holding means during unloading of said cartridge.

7. Apparatus according to claim 1 including latch means connected to said rack for maintaining a print element on said holding means when said print element is not in said cartridge.

8. Apparatus according to claim 1 wherein said elevating means includes means for lowering said rack following insertion of a print element into said cartridge and for removal of a print element from said cartridge.

9. Apparatus according to claim 1 wherein said rack includes a plurality of said holding means.

10. Font changing apparatus for a daisy wheel printer which utilizes a print element housed in a vertically oriented cartridge carried by a carrier during printing and which has a selection motor drive hub for rotating said print element during printing and translatable toward and away from said print element, said apparatus comprising in combination:

(a) an elongated and vertically oriented rack having a plurality of holding means, each of which is for holding, and loading and unloading a print element into and from said cartridge;

(b) means connected to said rack for vertically elevating said rack for loading a print element into said cartridge, and inserting said holding means into said cartridge for unloading a print element from said cartridge; and (c) spring means included in said cartridge for (1) maintaining said print element on said holding means until said hub is translated toward and engages said print element, and (2) causing engagement of said print element and said holding means upon said hub being translated away from said print element.

11. Apparatus according to claim 10 including latch means associated with said rack for maintaining a print element on said holding means when said print element is not in said cartridge.

12. Apparatus according to claim 10 wherein said elevating means includes means for lowering said rack for removal of a print element from said cartridge.

* * * * *